United States Patent [19]

Hayashi

[11] Patent Number: 4,827,750

[45] Date of Patent: May 9, 1989

[54] METHOD OF PIERCING AND MANUFACTURING SEAMLESS TUBES

[75] Inventor: Chihiro Hayashi, Amagasaki, Japan

[73] Assignee: Sumitomo Metal Industries, Ltd., Osaka, Japan

[21] Appl. No.: 173,636

[22] Filed: Mar. 25, 1988

[30] Foreign Application Priority Data

Mar. 27, 1987 [JP] Japan ..... 62-75226

[51] Int. Cl.[4] ..... B21B 19/04

[52] U.S. Cl. ..... 72/97

[58] Field of Search ..... 72/96, 97

[56] References Cited

U.S. PATENT DOCUMENTS

| | | | |
|---|---|---|---|
| 2,017,388 | 10/1935 | Bannister | 72/97 |
| 3,719,066 | 3/1973 | Okamoto et al. | 72/97 |
| 4,470,282 | 9/1984 | Hayashi | 72/97 |

OTHER PUBLICATIONS

Copy of French Search Report.

Steel in the USSR, vol. 7, No. 11, Nov. 1977, pp. 627–632; P. I. Polukhin et al., "Development of Processes for Plastic Deformation of Metals".

Patent Abstracts of Japan, vol. 11, No. 94 (M-574) [2541], Mar. 25, 1987; JP-A-61 245 906 (Sumitomo Metal Ind. Ltd.) 1/11/86.

*Primary Examiner*—Lowell A. Larson

*Attorney, Agent, or Firm*—Burns, Doane, Swecker & Mathis

[57] ABSTRACT

In a method of manufacturing seamless tubes according to the present invention, piercing from a solid billet can be accomplished through one pass by means of a piercing mill ao the present invention, piercing from a solid billet can be accomplished through one pass by means of a piercing mill at the piercing ratio above 4.0 or the expansion ratio above 1.15, or the wall thickness/outside diameter ratio below 6.5%, and the piercing mill having cone-shaped rolls is used with its feed angle $\beta$ and cross angle $\gamma$ satisfying the following relations, $8° \leqq \beta \leqq 20°$ $5° \leqq \gamma \leqq 35°$ $15° \leqq \beta + \gamma \leqq 50°$ and the solid billet diameter $d_o$, outside diameter d and wall thickness t of a hollow shell after piercing satisfying a prescribed condition for realization, thereby manufacturing equipments can be largely simplified.

6 Claims, 4 Drawing Sheets

PROIR ART

METHOD OF PIERCING AND MANUFACTURING SEAMLESS TUBES

BACKGROUND OF THE INVENTION

1. Field of the Invention

The present invention relates to a method of piercing and manufacturing seamless tubes comprising a piercing process wherein a solid billet as a material for the seamless tubes is made thinner at high processability.

2. Description of the Prior Art

The Mannesmann plug mill process or Mannesmann mandrel mill process is most widely used hitherto as a method of manufacturing seamless tubes. In these processes, the solid billet heated to the prescribed temperature through a heating furnace is pierced with a piercing mill into a hollow piece, which is rolled into a hollow shell by means of an elongator, e.g. rotary elongator, a plug mill or mandrel mill, by reducing mainly its wall thickness, then the outside diameter is reduced by means of a reducing mill such as a sizer or stretch reducer to obtain finished seamless tubes having the specified dimensions.

Technical contents of our prior invention disclosed in U.S. Pat. No. 4,470,282 characterized particularly in a piercing method of such manufacturing process of seamless tubes will be described hereinbelow.

In the prior invention, a feed angle $\beta$ (an angle which the roll axis makes with a horizontal or vertical plane of the pass line and a cross angle $\gamma$ (an angle which the roll axis makes with a vertical or horizontal plane of the pass line) of cone-shaped main rolls supported at both ends, and disposed in horizontally or vertically opposed relation with the billet/hollow piece pass line therebetween are retained in the following ranges, $$3^\circ < \beta < 25^\circ$$

$$3^\circ < \gamma < 25^\circ$$

$$15^\circ < \beta + \gamma < 45^\circ$$

and disc rolls disposed in vertically or horizontally opposed relation between said main rolls with the pass line therebetween, are pressed against the billet and hollow piece during piercing operation.

The prior invention is substantially contradictory to a piercing principle of the Mannesmann process, in which piercing is effected by using a so-called rotary forging effect (Mannesmann effect), whereas in the prior invention, (1) occurrence of the rotary forging effect (Mannesmann effect) is restrained as much as possible, and (2) the circumferential shear deformation $\gamma_{r\theta}$ or shear strain due to surface twist $\gamma_{\theta l}$ produced during piercing process is restrained as much as possible, to realize the metal flow equivalent or proportional to the extrusion process though being rotary rolling.

For this purpose, the piercing mill is constructed to enable the high cross angle and high feed angle piercing, the main rolls are made conical and instead of guide shoes, disc rolls are employed. As a result of killing thereby the rotary forging effect (Mannesmann effect) to restrain initiation of inside bore defects and, in particular, releasing shear stress field of the circumferential shear deformation $\gamma_{r\theta}$ to restrain propagation of the inside bore defects, the tube making of so-called materials of poor workability, such as a high alloy, super alloy and the like, e.g., Inconel, Hastelloy, etc., not to speak of free cutting steel and stainless steel which has had no way but to rely on the Ugine-Sejournet extrusion process hitherto is becoming possible.

Also, in a continuously cast billet having a center porosity, tubes can be manufactured without producing micro bore defects, thus contributing largely to advantages of rationalization such as manufacturing costs and the like.

Problems to be Solved by the Invention

In general, longitudinal, radical and circumferential strains, $\psi_l$, $\psi_r$ and $\psi_\theta$ in piercing may be represented by the following equations, where the outside diameter and length of the solid billet before piercing are designated as $d_o$, $l_o$ and those and thickness of a hollow piece after piercing are designated as d, l and r:

$$\psi_l = \ln \frac{l}{lo} = \ln \frac{do^2}{4(d - t)t}$$

$$\psi_r = \ln \frac{2t}{do}$$

$$\psi_\theta = \ln \frac{2(d - t)}{do}$$

here, $\psi_l + \psi_r + \psi_\theta =$

Though, by usage, indexes of piercing ratio and expansion ratio are used, they do not represent the quantity of deformation accurately, but defined as, $$\text{piercing ratio } \frac{l}{lo} = \frac{do^2}{4t(d - t)},$$

expansion ratio $d/d_o$, which are just criteria for the degree of deformation. Since their intuitional meanings are clear, however, they are often used as indexes for deformation and are also utilized in the following description.

Now, in the usual piercing, though the piercing ratio is only about 3.0~3.3 and the expansion ratio about 1.05~1.08, our prior invention was also based upon such common ranges.

Accordingly, if the piercing ratio or expansion ratio is increased excessively above this, the rotary forging effect is emerged excessively to cause severe circumferential shear stress field in piercing, leading to the inevitable inside bore defect formation whereby a double piercing method using two piercing mills has had to be employed.

That is to say, the billet should be bored with the first piercing mill, and with the second piercing mill the wall thickness was reduced by further elongation (in this case, the second piercing mill is called a rotary elongator) or by expansion of 30 to 50% (in this case, the second piercing mill is called a rotary expander).

SUMMARY OF THE INVENTION

The above is the technical background in which the present invention has been made.

It is therefore an object of the present invention to provide a method of piercing in seamless tube manufacturing which makes it possible to realize the piercing by one piercing mill instead of two piercing mills used hitherto.

It is another object of the present invention to provide a method of manufacturing seamless tubes which makes it possible to bear 90 to 95% of the total processing with the piercing mill. That is, the present invention is directed to the production of a hollow shell which is close to the final product by means of the piercing mill.

It is a further object of the present invention to provide a method of piercing which makes it possible to restrain initiation and propagation of inside bore defects.

The major point of the present invention is to retain a feed angle $\beta$ and a cross angle $\gamma$ of cone-shaped main rolls supported at both ends and disposed opposedly with a pass line therebetween, in the following ranges, $$8° \leqq \beta \leqq 20°$$

$$5° \leqq \gamma \leqq 35°$$

$$15° \leqq \beta + \gamma \leqq 50°$$

to satisfy the following relationship simultaneously between the diameter $d_o$ of the solid billet and the outside diameter d and wall thickness t of the hollow shell after piercing, $$1.5 \leqq -\psi_r/\psi_\theta \leqq 4.5$$

provided, $$\psi_r = \ln \frac{2t}{do}$$

$$\psi_\theta = \ln \frac{2(d-t)}{do}$$

and to bring the piercing ratio above 4.0, the expansion ratio above 1.15 and the thickness/outside diameter ratio below 6.5%. Thereby, the thin wall piercing may be accomplished at high processability through a single piercing process for almost all manufacturing processes of the seamless tubes.

The above and further objects and features of the present invention will more fully be apparent from the following detailed description with accompanying drawings.

DESCRIPTION OF THE PREFERRED EMBODIMENTS

Figure 1:
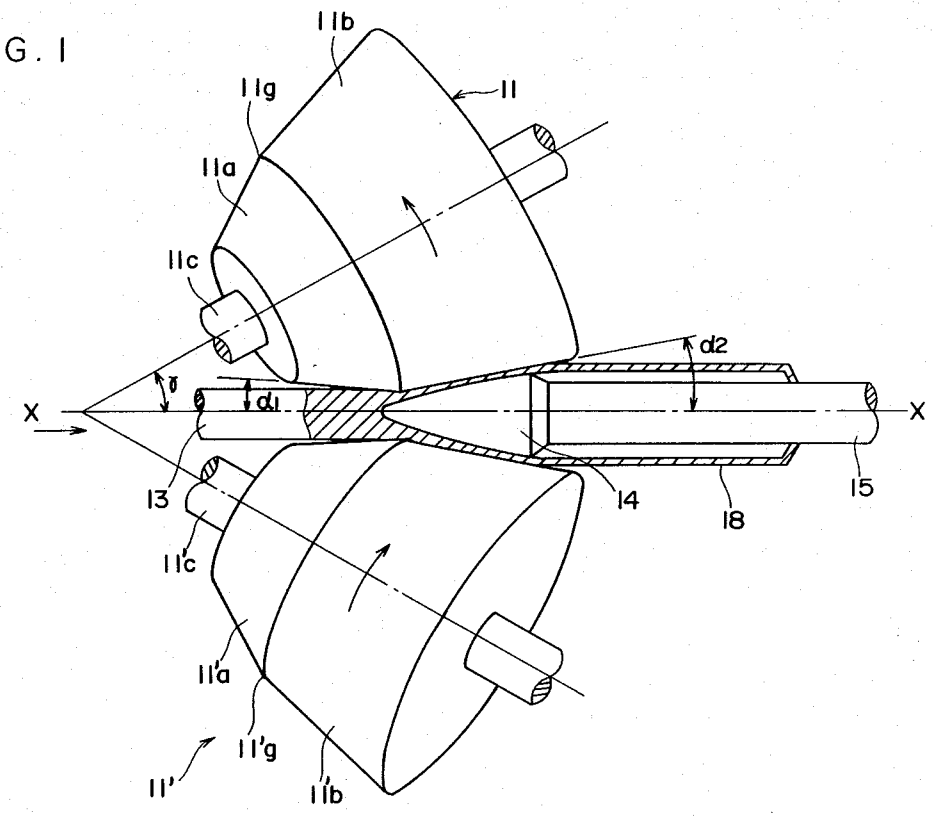
FIG. 1 is a schematic plan view showing the embodiment of a method of the present invention.

On the basis of experiment results conducted by the inventor, the present invention will be specifically described hereinbelow.

Piercing Conditions

In the course of challenging, by using a piercing mill related to the prior invention aforementioned, to the limit of piercing ratio and expansion ratio, that is, thin wall piercing at high processability by thin wall piercing with the high piercing ratio and high expansion ratio, and continuing the study and research as changing piercing conditions widely, it is found that the conditions which were almost negligible in the case of piercing with the common piercing ratio or expansion ratio, has come to the surface to cause problems in the case of such thin wall piercing at high processability.

This is concerned with whether or not the piercing operation is realized, and forming fundamental principles how to distribute rolling reduction of the wall thickness axially and circumferentially in piercing. Any deviation from the principles may cause flaring (a protrusion phenomenon) or blocking and suspending the piercing operation itself.

Results of experiments particularly carried out with respect to how the wall thickness reduction must be distributed longitudinally and circumferentially will not be described.

Using a cross-roll type rotary piercing mill, a possible piercing range in which the piercing can be made possible without producing any flaring or blocking has been studied through the piercing experiments, as changing diameters of the solid billets and plugs by changing a feed angle $\beta$ of the main rolls in 7 steps from 8° to 20° with 2° interval therebetween, and a cross angle $\gamma$ in 7 steps from 5° to 35° with 5° interval therebetween.

In this case, the diameter of gorge portion of the main rolls is 350 mm and the rotating speed is 60 rpm. For holding the hollow shell, guide shoes or disc rolls of 900 mm diameter were used to compare influences exerted on the pierceability. Test billets were of a forged carbon steel material in 4 kinds having the diameters of 55 mm, 60 mm, 65 mm and 70 mm. The plugs were in 7 kinds having the diameters of 50 mm, 55 mm, 60 mm, 70 mm, 80 mm, 90 mm and 100 mm. All combinations were made between each billet and plug in the experiments.

The resulted condition in which piercing can be made possible is expressed by the following equation:

$$1.5 \leqq -\psi_r/\psi_\theta \leqq 4.5 \quad (1)$$

provided, $$\psi_r = \ln \frac{2t}{do} \quad (2)$$

$$\psi_\theta = \ln \frac{2(d-t)}{do} \quad (3)$$

The reason why $-\psi_r/\psi_\theta \leqq 4.5$ is that, if $-\psi_r/\psi_\theta > 4.5$, the flaring is occured during piercing, causing the tube wall to protrude between the main rolls and the guide shoes or disc rolls and eventually suspending the piercing. Likewise, the reason why $1.5 \leqq -\psi_r/\psi_\theta$ is that, if $1.5 > -\psi_r/\psi_\theta$, clearance between the periphery of the plugs and the hollow shell is narrowed, occuring the blocking to stop the piercing itself.

Also, if the wall thickness of hollow shell becomes excessively thin, the tube wall may be torn and peeled (a peeling phenomenon) by the disc rolls or by edges of the guide shoes. When using the disc rolls, the peeling tends to occur more as compared with the case where the guide shoes are used, therefore it is estimated that the limit of wall thickness ratio (t/d) of the hollow shell in the case of disc rolls is approximately 3% and that in the case of guide shoes is approximately 1.5%. Though the difference between them is just 1.5%, from the point of processability, the limit of the former is as large as that of the latter, and from a viewpoint of production technique it can not be neglected at all.

Next, in the thin wall piercing process at such a high processability, the rotary forging effect tends to occur more strongly as aforementioned, increasing the metal flow of the circumferential shear deformation $\gamma_{r\theta}$ during piercing to cause a severe shear stress field. That is to say, the inside bore defects and laminations tend to occur. In order to restrain such problems, ranges applicable to the feed angle $\beta$, cross angle $\gamma$ and their sum $\beta+\gamma$ are examined, and the results are as follows:

$$8^\circ \leqq \beta \leqq 20^\circ \quad (4)$$

$$5^\circ \leqq \gamma \leqq 35^\circ \quad (5)$$

$$15^\circ \leqq \beta+\gamma \leqq 50^\circ \quad (6)$$

In particular, when piercing high alloy steel of a material of poor workability in a thin wall at high processability, the following equations are satisfied:

$$10^\circ \leqq \beta \leqq 20^\circ \quad (4')$$

$$25^\circ \leqq \gamma \leqq 35^\circ \quad (5')$$

$$35^\circ \leqq \beta+\gamma \leqq 50^\circ \quad (6')$$

In the prior invention aforementioned, with respect to the numerical ranges of the feed angle $\beta$, cross angle $\gamma$ and their sum $\beta+\gamma$, though their upper limits were decided from restrictions on the mechanical construction, as to be described later, in the present invention, due to improvements of the supporting structure of the roll axis end on the inlet side, the restrictions on mechanical structure with respect to $\beta$, $\gamma$ and $\beta+\gamma$ is relieved and the upper limits were decided from the viewpoint of circumferential shear deformation $\gamma_{r\theta}$ in the same way as the lower limits.

That is to say, the reason why $\gamma \leqq 35^\circ$ is that, if $\gamma > 35^\circ$, the metal flow of circumferential shear deformation $\gamma_{r\theta}$ is overshot to cause occurrence of the reversed metal flow. Likewise, it is the same reason for the feed angle $\beta$, since if $\beta > 20^\circ$ the metal flow will be reversed as the result of largely enlarged upper limit of the cross angle $\gamma$ from 25° to 35°. It holds true also in the upper limit of the sum of feed angle $\beta$ and cross angle $\gamma$.

Meanwhile, the lower limits of feed angle $\beta$, cross angle $\gamma$ and their sum $\beta+\gamma$ are decided taking into account of the limits being able to prevent the inside bore defect formation caused by the rotary forging effect (Mannesmann effect) and circumferential shear deformation.

Example of Equipment for carrying out the Method of Present Invention

Constructions of a piercing mill used in the embodiments of the present invention, in particular, in the case of thin wall piercing at high processability with a high piercing ratio and tube expansion ratio will be described as illustrated in FIG. 1 through FIG. 4.

Figure 2:
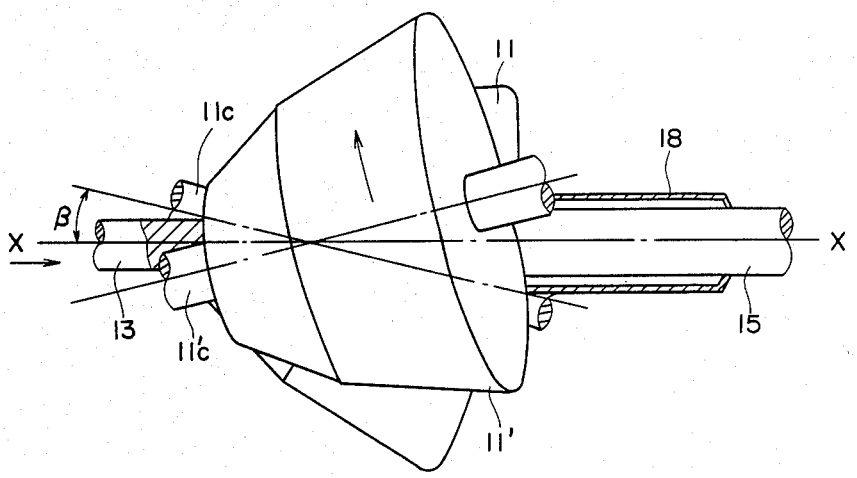
FIG. 2 is a schematic side view showing the embodiment of a method of the present invention.
Figure 3:
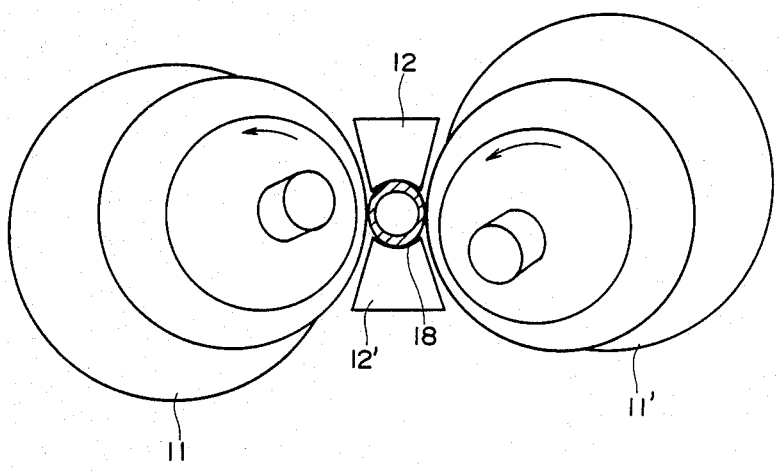
FIG. 3 is a schematic front view showing the embodiment of a method of the present invention.
Figure 4:
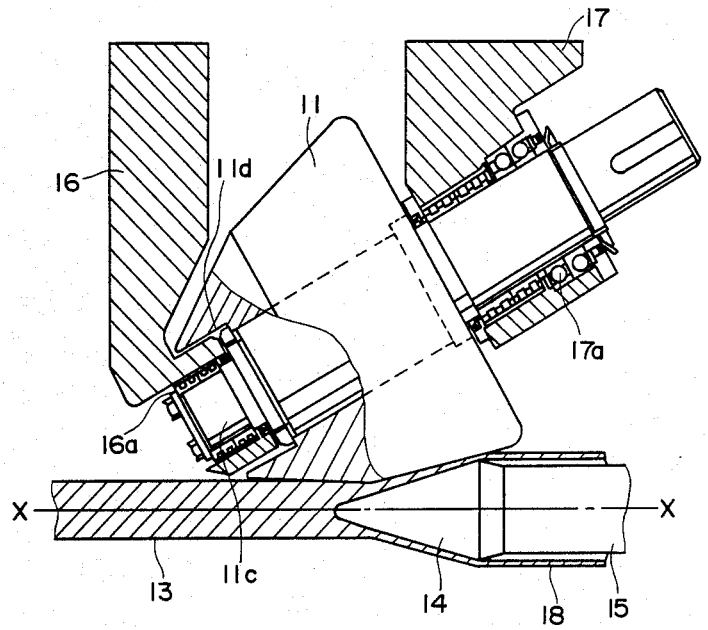
FIG. 4 is a fragmentary sectional view showing a supporting construction of the main roll axis end of a cross-roll type rotary piercing mill used in a method of the present invention.

FIG. 1 is a schematic plane view showing the state wherein a method of the present invention is carried out, FIG. 2 is also a schematic side view, FIG. 3 is a schematic front view looking from the inlet side and FIG. 4 is a fragmentary sectional view showing a supporting construction at main roll axis ends.

Main rolls 11,11' are cone shaped, having roll surfaces 11*a*, 11*a'* of an inlet-face angle $\alpha$, on the inlet side of a solid billet 13, and roll surfaces 11*b*, 11*b'* of an outlet-face angle $\alpha_2$ on the outlet side, with gorge portions 11*g*, 11*g'* formed at the intersection between the roll surfaces 11*a*, 11*a'* on the inlet side and the roll surfaces 11*b*, 11*b'* on the outlet side, each roll axis 11*c*, 11*c'* being supported at both ends thereof by bearings 16*a*, 17*a* on supporting frames 16, 17. The roll axes 11*c*, 11*c'* are arranged in such a way that their prolongations extend at an equal feed angle $\beta$ in opposite directions relative to a horizontal plane, or a vertical plane differing from the figure, including a pass line X—X through which the solid billet 13 passes, and that said propagations cross at a symmetrical cross angle $\gamma$ relative to a vertical plane, or a horizontal plane differing from the figure, including the pass line X—X, and that they are adapted to rotate each other in the same direction as indicated by the arrow at a same angular velocity.

Between the main rolls 11, 11', as shown in FIG. 3, there are disposed guide shoes 12, 12' with a hollow shell 18 being interposed therebetween from both the top side and underside, or from both sides differing from the figure, of the pass line X—X. The guide shoes 12, 12' may be replaced by driven disc rolls. The front end of a piercing plug 14 supported by a mandrel 15 at its rear portion is positioned at a location spaced by a prescribed distance from the gorge portions 11*g*, 11*g'* toward the inlet side of the solid billet 13.

Now, it is to be noted that the supporting construction of the roll axis end on the inlet side has been largely improved from that of the piercing mill of our prior invention.

Figure 5:
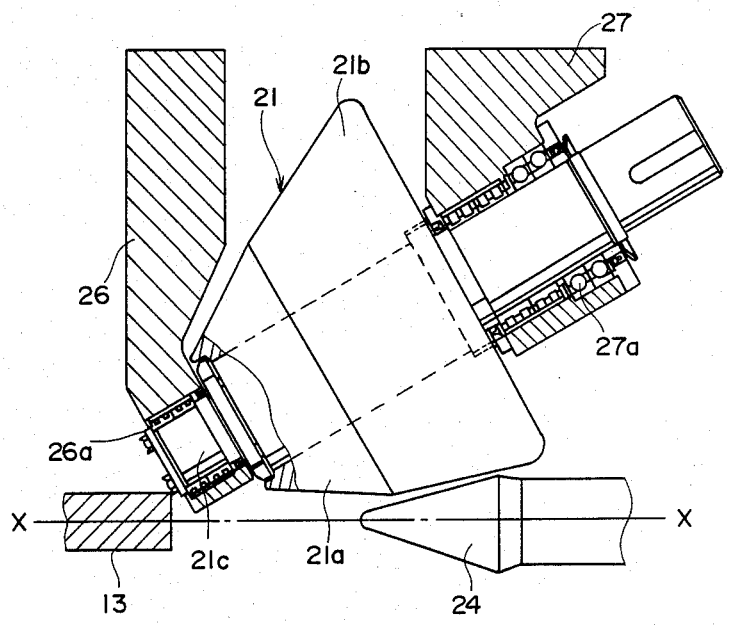
FIG. 5 is a fragmentary sectional view showing a supporting construction of the main roll axis end of a conventional cross-roll type rotary piercing mill.

FIG. 5 is a fragmentary sectional view showing the conventional supporting construction of the main roll axis end. In the prior invention, a main roll 21 is constructed as such that its axis ends protruding from the roll surfaces 21*a*, 21*b* on the inlet and outlet sides are supported by bearings 26*a*, 27*a* on supporting frames 26, 27, thus if a cross angle is above 25°, the ends of roll axis tends to enter into the pass line of the solid billet 13, substantially interfering the milling operation.

On the contrary, in an equipment for carrying out the method of present invention, as shown in FIG. 4, both ends of the roll axis 11*c* of the main roll 11 are respectively supported on the supporting frames 16, 17 through the bearings 16*a*, 17*a*, but the bearing 16*a* on the inlet side is positioned in an annular channel 11*d* formed by partly expanding an axis hole through which the roll axis 11*c* passes and a support of supporting frame 16 is also mostly positioned in the annular channel 11*d*. Thereby, a mechanical interference between the bearing 16*a* on the inlet side and the solid billet being fed is avoided and the cross angle $\gamma$ could be brought close to 35°. Thus the upper limit of the cross angle $\gamma$ has been largely risen as such, biasing by the disc rolls during piercing is not necessarily required as in the prior invention.

EXAMPLE 1

Though a cast billet of austenitic stainless steel produced through continuous casting has a fairly poor hot workability austenitic stainless steel with Nb additive (18Cr-8Ni-1Nb) having, in particular, a poor hot workability was selected, and a billet of 60 mm diameter d was formed from the center portion of the cast billet of 187 mm diameter produced through the horizontal continuous casting to perform a thin wall piercing test at a high piercing ratio with a cross-roll type piercing mill.

Particular of Piercing Mill
Main roll cross angle $\gamma$: 20°
Main roll feed angle $\beta$: 16°
Main roll gorge diameter: 350 mm
Plug diameter: 55 mm
Disc roll diameter: 900 mm
Piercing Conditions
Solid billet diameter $d_o$: 60 mm
Hollow shell out, diameter d: 60.7 mm
Hollow shell wall thickness t: 1.7 mm
Piercing ratio: 9.0 (conventional maximum piercing ratio is about 3.0~3.3)
Expansion ratio: 1.01
Wall thickness/diameter: 2.8% (conventional minimum wall thickness/diameter is 8~10%)
Radial logarithmic strain $$\psi_r = \ln \frac{2t}{do} = -2.87$$

Circumferential logarithmic strain $$\psi_\theta = \ln \frac{2(d-t)}{do} = 0.68$$

$$-\psi_r/\psi_\theta = 4.22$$

A circumferential and longitudinal reduction distribution ratio was proper, and the piercing was accomplished smoothly without producing flaring and blocking.

Meanwhile, a Mannesmann-plug mill process is employed widely internationally as a manufacturing method, in particular, of medium-diameter seamless tubes. In this process, piercing is carried out in such a way that first, the billet is bored by the piercing mill, its wall thickness is reduced by a rotary elongator, by means of a plug mill it is elongated for further reduction, its inside surface is reeled by a reeler, then reducing its outside diameter by means of a reducing mill such as a sizer (sizing mill), stretch reed by a reeler, then reducing its outside diameter by means of a reducing mill such as a sizer (sizing mill), stretch reducer (stretch reducing mill) or rotary sizing mill and the like, to finish into prescribed dimensions, whereas the high piercing ratio thin wall piercing method of the present invention is designed to accomplish the processings carried out by the 4 rolling mills, i.e. the piercing mill, rotary elongator, plug mill and reeler, with a single cross-type piercing mill. Therefore, it may be said that a technical concept of the present invention involves, in particular, a miraculous manufacturing method. Of course, such a mill as a rotary elongator can be very easily omitted.

In the embodiment, since the rotary forging effect (Mannesmann effect) is restrained and the shear stress field is released, occurrence of inside bore defects could be hardly recognized, though piercing being the miraculous super thin-wall piercing and the material to be processed having an extremely poor hot workability of the material being processed. Of course, the piercing operation was so stable that such troubles as flaring, blocking or peeling were hardly seen in piercing of all 20 samples.

Likewise, when illustrating the effect in the manufacturing process of small diameter seamless tubes, it means that among processings by the piercing mill, rotary elongator (not used in most cases), 8-stand mandrel mill, reheating furnace and stretch reducer, the processings by the piercing mill, rotary elongator and 8-stand mandrel mill can be performed by one cross-roll type piercer, results in eliminating cooling of the hollow shell and consequently omitting the reheating furnace. Thus, its economical advantage is immeasurable, besides it is needless to say that the mandrel mill which usually comprises 8 stands (elongation ratio: max. 4.5) can be very easily reduced below 4 stands (elongation ratio: less than 2.5) by executing the thin-wall piercing at high processability in the cross-roll type piercer.

In addition, it is noticeable that regardless of the medium or small diameter, there is possibility of omitting not only the elongating process but also the reducing process. That is, according to the present technique, the final product may be finished with the one cross-roll type piercer if the diameter is sized in the piercing process.

EXAMPLE 2

High alloy steel (25Cr—20Ni) of a still more poor hot workability was chosen and in the same way as the Example 1, a billet of 55 mm diameter $d_o$ was formed from the center portion of a cast billet of 187 mm diameter produced through the horizontal continuous casting to perform a thin wall piercing test at a high expansion ratio.

Particulars of the Piercing Mill
Main roll cross angle $\gamma$: 25°
Main roll feed angle $\beta$: 12°
Main roll gorge diameter: 350 mm
Plug diameter: 100 mm
Piercing Conditions
Solid billet diameter $d_o$: 55 mm
Hollow shell out diameter d: 110.8 mm
Hollow shell wall thickness t: 1.8 mm
Piercing ratio: 3.9 (conventional maximum piercing ratio is 3.0~3.3)
Expansion ratio: 2.02 (conventional maximum expansion ratio is 1.05~1.08)
Wall thickness/diameter: 1.6% (conventional minimum wall thickness/diameter is 8~10%)
Radial logarithmic strain, $$\psi_r = \ln \frac{2t}{do} = -2.73$$

Circumferential logarithmic strain, $$\psi_\theta = \ln \frac{2(d-t)}{d} = 1.38$$

$$-\psi_r/\psi_\theta = 1.98$$

A circumferential and longitudinal reduction distribution ratio was proper and the piercing was accomplished smoothly without producing flaring and blocking.

Meanwhile, though an expanding mill, a so-called rotary expander as the rolling mill for expanding the pierced hollow shell exists as an equipment for manufacturing large diameter seamless tubes, considering the fact that its expansion ratio is only approximately 1.3~1.5 and the ratio between the wall thickness and outside diameter of the hollow shell is also only about 5~7%, the technical concept of the present invention whereby the piercing and expansion can be accomplished by the same process to realize the wall thickness/diameter ratio of 1.5% is, in particular, an epochal manufacturing method.

Now, also in this piercing experiment, though miraculous piercing and expansion can be accomplished due to the high cross angle and feed angle piercing method and regardless of a very poor hot workability of the material, the hollow steel after piercing was free from any inside bore defects and laminations produced by cracks in the wall thickness.

The piercing operation in this example was also so stable that such troubles as flaring and blocking were hardly seen in piercing of all 20 samples. Also, occurrence of peeling troubles was prevented due to the guide shoes employed instead of the disc rolls.

EXAMPLE 3

In view of the fact that high piercing ratio piercing was successful in Example 1 and the high expansion ratio piercing in Example 2, in Example 3, mainly both atio piercing was successful in Example 1 and the high expansion ratio piercing in Example 2, in Example 3, mainly both the high piercing ratio piercing and high expansion ratio piercing were carried out. A forged elongated material of high alloy steel (30Cr—40Ni—3Mo) was used as a sample and the diameter of solid billet was 60 mm. The guide shoes were employed in piercing.

Particulars of the Piercing Mill
Main roll cross angle $\gamma$: 30°
Main roll feed angle $\beta$: 14°
Main roll gorge diameter: 350 mm
Plug diameter: 90 mm
Piercing Conditions
Solid billet diameter $d_o$: 60 mm
Hollow shell diameter d: 101.8 mm
Hollow shell wall thickness t: 1.8 mm
Piercing ratio: 5.0 (conventional maximum piercing ratio is about 3.0~3.3)
Expansion ratio: 1.70 (conventional maximum expansion ratio is 1.05~1.08)
Wall thickness/diameter: 1.8% (conventional minimum wall thickness/diameter is 8~10%)
Radial logarithmic strain, $$\psi_r = \ln \frac{2t}{do} = -2.81$$

Circumferential logarithmic strain, $$\psi_\theta = \ln \frac{2(d-t)}{do} = 1.10$$

$$-\psi_r/\psi_\theta = 2.34$$

A circumferential and longitudinal reduction distribution ratio was proper, and the piercing was accomplished smoothly without producing flaring and blocking.

Of course, also in this experiment, since the high cross angle and feed angle piercing method was employed, regardless of piercing at a miraculous high piercing and expansion ratio and the material having a very poor hot workability, the hollow shell after piercing was free from any inside bore defects and laminations produced by cracks in the wall thickness. Piercing operation was also so stable that such troubles as flaring, blocking and peeling were hardly seen in piercing of all 20 samples.

As aforementioned, the present invention is advantageous in that, the thin wall piercing can be accomplished smoothly at high processability without producing such troubles as the inside bore defect, lamination, flaring, blocking, peeling etc. And the piercing mill, elongator, plug mill and reeler used hitherto in the manufacturing process of medium diameter seamless tubes can be replaced by one cross-roll type piercing mill, thereby equipments are largely omitted and consequently power consumptions, floor spaces and production costs can be reduced.

Likewise, when illustrating the effects in the manufacturing process of small diameter seamless tubes, it means that among processings by the piercing mill, rotary elongator (not used in most cases), 8-stand mandrel mill, (reheating furnace), and stretch reducer, the processings from the piercing mill to the 8-stand mandrel mill can be performed by one cross-roll type piercer, resulting in eliminating cooling of the hollow shell and consequently omitting the reheating furnace.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within the meets and bounds thereof are intended to be embraced by the claims.

What is claimed is:

1. A method of manufacturing seamless tubes, wherein a feed angle $\beta$ and cross angle $\gamma$ of cone-shaped main rolls supported at both ends and disposed in opposed relation with a pass line interposed therebetween are retained in the following ranges, $$8° \leqq \beta \leqq 20°$$

$$5° \leqq \gamma \leqq 35°$$

$$15° \leqq \beta + \gamma \leqq 50°$$

simultaneously, the diameter $d_o$ of a solid billet and the outside diameter d and thickness t of a hollow shell after piercing are established in the following relation, $$1.5 \leqq -\psi_r/\psi_\theta \leqq 4.5$$

provided, $$\psi_r = \ln \frac{2t}{do}$$

$$\psi_\theta = \ln \frac{2(d-t)}{do}$$

and the piercing ratio is above 4.0, the expansion ratio above 1.15 or the wall thickness/diameter ratio below 6.5%.

2. A method of manufacturing medium diameter seamless tubes characterized in that, a hollow shell manufactured by a method as claimed in claim 1 is elongated with a plug mill and sized with a sizer after reeling. (A rotary elongator is omitted).

3. A method of manufacturing medium diameter seamless tubes characterized in that, a hollow shell manufactured by a method as claimed in claim 1 is directly sized with a sizer.

4. A method of manufacturing small diameter seamless tubes characterized in that, a hollow shell manufactured by a method as claimed in claim 1 is elongated at an elongation ratio of less than 2.5 by means of a mandrel mill having a small numbers of stands below 4, then its outside diameter is reduced and sized by means of a stretch reducer for sizing.

5. A method of manufacturing small diameter seamless tubes characterized in that, a hollow shell manufactured by the method as claimed in claim 1 is directly reduced and sized by means of a stretch reducer.

6. A method of manufacturing seamless tubes characterized in that, a hollow shell manufactured by the method as claimed in claim 1 is simultaneously sized to finished product in the piercing process.

* * * * *

UNITED STATES PATENT AND TRADEMARK OFFICE

CERTIFICATE OF CORRECTION

PATENT NO. : 4,827,750

DATED : May 9, 1989

INVENTOR(S) : Chihiro HAYASHI

It is certified that error appears in the above-indentified patent and that said Letters Patent is hereby corrected as shown below:

Column 3, line 32, "and" should read --or--.

Signed and Sealed this

Third Day of January, 1995

*Attest:*

*Attesting Officer*

BRUCE LEHMAN

*Commissioner of Patents and Trademarks*